US006475252B1

(12) United States Patent
Heneghan et al.

(10) Patent No.: US 6,475,252 B1
(45) **Date of Patent: *Nov. 5, 2002**

(54) STABILIZING ADDITIVE FOR THE PREVENTION OF OXIDATION AND PEROXIDE FORMATION

(75) Inventors: Shawn P. Heneghan, Dayton, OH (US); Steven S. Zabarnick, Dayton, OH (US); Mark S. Mick, Scott, LA (US)

(73) Assignee: University of Dayton, Dayton, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/398,119

(22) Filed: Sep. 16, 1999

Related U.S. Application Data

(60) Provisional application No. 60/100,695, filed on Sep. 17, 1998, now abandoned.

(51) Int. Cl.[7] ..... C10L 1/18; C10L 1/24; C10L 1/26

(52) U.S. Cl. ..... 44/435; 44/450

(58) Field of Search ..... 44/450, 435

(56) References Cited

U.S. PATENT DOCUMENTS

| | | | | |
|---|---|---|---|---|
| 1,575,440 A | * | 3/1926 | Midgley | 44/435 |
| 2,202,877 A | | 6/1940 | Stevens et al. | |
| 2,368,866 A | * | 2/1945 | Nygaard | 44/435 |
| 2,378,793 A | | 6/1945 | Rudel | |
| 2,434,650 A | | 1/1948 | Herbst | |
| 2,627,511 A | | 2/1953 | Jones et al. | |
| 2,797,153 A | * | 6/1957 | Bereslavsky | 44/435 |
| 2,884,314 A | | 4/1959 | Smith | |
| 3,019,097 A | * | 1/1962 | Ecke | 44/450 |
| 3,035,908 A | | 5/1962 | Gottshall et al. | |
| 3,074,230 A | * | 1/1963 | De Vault | 44/435 |
| 3,322,649 A | | 5/1967 | O'Shea | |
| 3,654,154 A | | 4/1972 | Braid | |
| 3,929,654 A | * | 12/1975 | Brewster | 44/435 |
| 4,042,523 A | | 8/1977 | Brois | |
| 4,094,801 A | | 6/1978 | Forsberg | |
| 4,253,976 A | | 3/1981 | Forsberg | |
| 4,260,500 A | | 4/1981 | Forsberg | |
| 4,753,662 A | | 6/1988 | Lange | |
| 5,084,069 A | | 1/1992 | Farng et al. | |
| 5,362,783 A | | 11/1994 | Eiffler et al. | |
| 5,382,266 A | | 1/1995 | Lin et al. | |
| 5,509,944 A | | 4/1996 | Venkatadri et al. | |

OTHER PUBLICATIONS

Zabarnick et al, Studies of Hydroperoxide Decomposing species for inhibiting Oxidation in Jet fuels, Aug. 23, 1998.*

Denison et al., "Oxidation of Lubricating Oils Mechanism of Sulfur Inhibition" Industrial and Engineering Chemisty, Nov. 1945, pp. 1102–1108, vol. 37, No. 11.

Scott, G., "Antioxidants" Chemistry and Industry, Feb. 16, 1963, pp. 271–281.

(List continued on next page.)

*Primary Examiner*—Cephia D. Toomer
(74) *Attorney, Agent, or Firm*—Killworth, Gottman, Hagan & Schaeff, L.L.P.

(57) ABSTRACT

A liquid hydrocarbon stabilizer including a hindered phenol, and a peroxide decomposer selected from sulfides having a general formula $R_4$—S—$R_5$ and phosphine compounds having a general formula $PR_6R_7R_8$ where $R_4$, $R_5$, $R_6$, $R_7$, and $R_8$ are the same or different and are each alkyl, aryl, alkylaryl, arylalkyl, hydroxyalkyl, hydroxyaryl, hydroxyalkylaryl, hydroxyarylalkyl groups, or heteroatomic alkyl, aryl, alkylaryl, arylalkyl, hydroxyalkyl, hydroxyaryl, hydroxyalkylaryl, hydroxyarylalkyl groups containing nitrogen, sulfur, or oxygen. A method of treating liquid hydrocarbons with the liquid hydrocarbon is also described.

24 Claims, 4 Drawing Sheets

OTHER PUBLICATIONS

Steven Zabarnick, "Pseudo–Detailed Chemical Kinetic Modeling of Antioxidant Chemistry for Jet Fuel Applications" Energy & Fuels, p. 547–553, vol. 12, No. 3.

Zabarnick et al., "Aspects of Jet Fuel Oxidation" Journal of Engineering for Gas Turbines and Power, Jul. 1998, pp. 519–525, vol. 120.

Steven Zabarnick, "Studies of Jet Fuel Thermal Stability and Oxidation Using a Quartz Crystal Microbalance and Pressure Measurements" Ind. Eng. Chem. Res., 1994, pp. 1348–1354, vol. 33, No. 5.

Zabarnick et al., "Studies of Jet Fuel Additives Using the Quartz Crystal Microbalance and Pressure Monitoring at 140 C" Ind. Eng. Chem. Res., 1994, pp. 2771–2777, vol. 33, No. 11.

Heneghan et al., "JP–8+100: The Development of High–Thermal–Stability Jet Fuel" Journal of Energy Resources Technology, Sep. 1996, pp. 170–179, vol. 118.

* cited by examiner

STABILIZING ADDITIVE FOR THE PREVENTION OF OXIDATION AND PEROXIDE FORMATION

CROSS REFERENCE TO RELATED APPLICATIONS

This application claims the benefit of U.S. Provisional Application No. 60/100,695 filed Sep. 17, 1998, now abandoned.

BACKGROUND OF THE INVENTION

This invention relates generally to liquid hydrocarbon stabilizers, and more particularly to liquid hydrocarbon stabilizers containing hindered phenols and peroxide decomposers, and to methods of treating liquid hydrocarbons with liquid hydrocarbon stabilizers.

Hydrocarbon liquids, such as distillate fuels (gasoline, diesel fuel, and jet fuel), kerosene, and solvents are known to undergo reactions in the presence of oxygen. These reactions, called autoxidation, increase with temperature and extended storage time and result in the formation of oxidized products, specifically hydroperoxides. Oxidation is especially likely with liquid hydrocarbons that are strongly hydrotreated and those that are low in sulfur.

Distillate fuels contain varying amounts of natural oxidation inhibitors that prevent the formation of peroxides. However, these natural antioxidants may not always be present in sufficient quantities to prevent formation of peroxides. In addition, naturally occurring antioxidants are often removed from fuels by refinery treatment processes. Many solvents and kerosene essentially lack any natural antioxidants.

Hydroperoxides are known to be detrimental to fuel system components, such as "O" rings and gasket materials. They cause premature aging of these components, and the degradation of the elastomeric seals can result in fuel leaks and costly maintenance. Fuel leaks are not only an environmental problem due to the release of volatile hydrocarbons into the environment, they also present a substantial safety risk as a result of the threat of fire from fuel leaks near hot engine components.

In 1993, California specified substantially reduced sulfur containing compounds in diesel fuel. The "low sulfur" diesel fuel created significant fuel/material interaction problems. The problems appear to be related to the formation of peroxides in the diesel fuels during storage, particularly in tanks on diesel trucks which can keep the diesel fuel at temperatures sometimes as high as 300° F. As a result of these problems, California rescinded the low sulfur standard (less than 10 ppm) in favor of a 50 ppm sulfur standard, but the higher sulfur standard means a higher level of pollution. The U.S. Environmental Protection Agency is considering a new sulfur standard, making it likely the issue will arise again.

Many attempts have been made to solve the problem of oxidation of liquid hydrocarbons. The introduction of additives into liquid hydrocarbons has been used successfully for many years. The U.S. Air Force JP-8+100 program developed an additive package for jet fuel which significantly increases the thermal stability of the fuel, preventing the formation of deposits which result from fuel oxidation within aircraft fuel systems. See Heneghan, S. P., Zabarnick, S., Ballal, D. R., Harrison, W. E., J. Energy Res. Tech. 1996, 118, 170–179; and Zabarnick, S., and Grinstead, R. R., Ind. Eng. Chem. Res. 1994, 33, 2771–2777.

Other examples include U.S. Pat. No. 5,382,266, which teaches the application of phosphine and phosphates to distillate fuels to prevent fuel degradation (color degradation, particulate formation, and/or gum formation), and U.S. Pat. No. 5,509,944 which discloses the stabilization of gasoline by adding an effective amount of a primary antioxidant, such as phenylene diamine, a hindered monophenol, or mixtures of these, and a secondary antioxidant, such as dimethyl sulfoxide. The combination of phosphine and hindered phenols has been used as a stabilizer in thermoplastic polymers to prevent discoloration. See, U.S. Pat. No. 5,362,783.

There remains a need for an improved stabilizer to inhibit the oxidation and formation of peroxides in liquid hydrocarbons. There is a need for n stabilizer which improves the storage stability and consequent fuel/material incompatibilities in liquid hydrocarbons.

SUMMARY OF THE INVENTION

The present invention meets these needs by providing a liquid hydrocarbon stabilizer containing a combination of additives. The liquid hydrocarbon stabilizer includes a hindered phenol, and a peroxide decomposer selected from sulfides having a general formula $R_4$—S—$R_5$ and phosphine compounds having a general formula $PR_6R_7R_8$ where $R_4$, $R_5$, $R_6$, $R_7$, and $R_8$ are the same or different and are each alkyl, aryl, alkylaryl, arylalkyl, hydroxyalkyl, hydroxyaryl, hydroxyalkylaryl, hydroxyarylalkyl groups, or heteroatomic alkyl, aryl, alkylaryl, arylalkyl, hydroxyalkyl, hydroxyaryl, hydroxyalkylaryl, hydroxyarylalkyl groups containing nitrogen, sulfur, or oxygen.

The hindered phenol preferably has the general formula

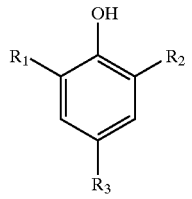

where $R_1$, $R_2$, and $R_3$ are the same or different and are each alkyl, aryl, alkylaryl, arylalkyl, hydroxyalkyl, hydroxyaryl, hydroxyalkylaryl, hydroxyarylalkyl groups, or heteroatomic alkyl, aryl, alkylaryl, arylalkyl, hydroxyalkyl, hydroxyaryl, hydroxyalkylaryl, hydroxyarylalkyl groups containing nitrogen, sulfur, or oxygen and where at least one of $R_1$ and $R_2$ provide stearic hindrance. $R_1$ and/or $R_2$ are preferably isobutyl or tertiary butyl groups. The hindered phenol is preferably either 2,6-di-tert-butyl-4-methylphenol or 6-tert-butyl-2,4-dimethylphenol. The to hindered phenol is preferably present in an amount in the range of from about 5 to about 50 mg/l.

The preferred sulfide compound is hexyl sulfide, and the preferred phosphine compound is triphenylphosphine.

The peroxide decomposer is preferably present in an amount less than about 10 g/l. When triphenylphosphine is used, it is preferably present in an amount of from about 20 to about 250 mg/l.

The present invention also includes a method of treating a liquid hydrocarbon by introducing a liquid hydrocarbon stabilizer as described into the liquid hydrocarbon.

Accordingly, it is an object of the present invention to provide a new and improved stabilizer to inhibit oxidation and formation of peroxides in liquid hydrocarbons and to provide a method of using such stabilizers. These and other objects, features and advantages of the present invention will become apparent from the drawings, detailed description and claims.

DETAILED DESCRIPTION OF THE INVENTION

Figure 1:
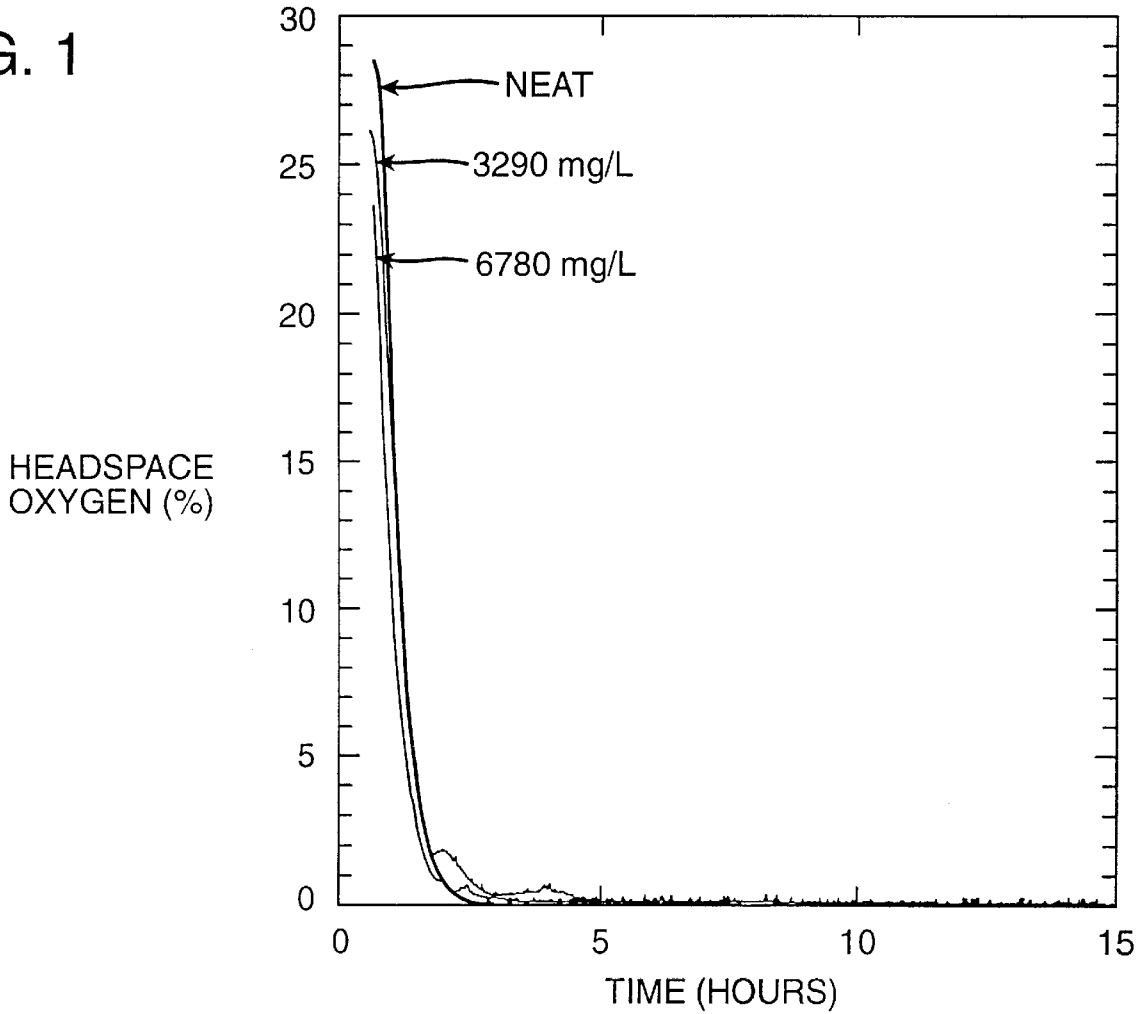
FIG. 1 is a plot of headspace oxygen against time for the oxidation of neat Exxsol D110 and with added hexyl sulfide.

The invention involves the use of a combination of additives to inhibit oxidation and the formation of peroxides in liquid hydrocarbons. The mechanism of the autoxidation cycle is shown below, where R is an alkyl radical, RH is a hydrocarbon, $RO_2$ is an alkylperoxy radical, is $RO_2H$ is an alkyl hydroperoxide, AH is a radical chain inhibitor, and SH is a peroxide decomposer.

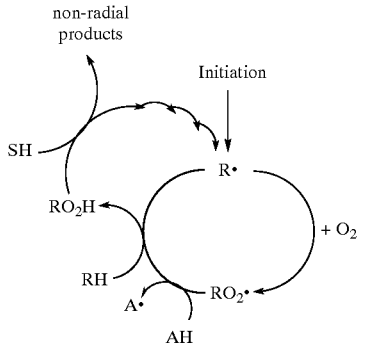

There are two main cycles: peroxy radical chain oxidation and peroxide decomposition resulting in chain initiation. Peroxy radicals are intercepted via introduction of a hindered phenol, such as 2,6-di-tert-butyl-4-methylphenol (BHT), while hydroperoxides are decomposed by the introduction of a phosphine or sulfide compound, such as triphenylsulfide (TPP) or hexyl sulfide. These two additives types work together synergistically to reduce the hydrocarbon oxidation rate as well as the hydroperoxide level. These classes are known generically as radical chain inhibitors (AH) and peroxide decomposers (SH) as shown above.

Radical chain inhibitors (AH) are generally of the proton donor type known as hindered phenols. The preferred form of hindered phenol (although other forms could also be used) is:

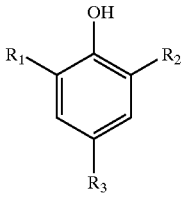

where $R_1$, $R_2$, and $R_3$ are the same or different and are each alkyl, aryl, alkylaryl, arylalkyl, hydroxyalkyl, hydroxyaryl, hydroxyalkylaryl, hydroxyarylalkyl groups, or heteroatomic alkyl, aryl, alkylaryl, arylalkyl, hydroxyalkyl, hydroxyaryl, hydroxyalkylaryl, hydroxyarylalkyl groups containing nitrogen, sulfur, or oxygen and at least one but preferably two of $R_1$ and $R_2$ provide stearic hindrance. $R_1$ and/or $R_2$ are preferably isobutyl or tertiary butyl groups. Preferred examples of hindered phenols are 2,6-di-tert-butyl-4-methylphenol (BHT), and 6-tert-butyl-2,4-dimethylphenol.

The peroxide decomposers (SH) are generally sulfides having a general formula $R_4$—S—$R_5$ and phosphine compounds having a general formula $PR_6R_7R_8$ where $R_4$, $R_5$, $R_6$, $R_7$, and $R_8$ a same or different and are each alkyl, aryl, alkylaryl, arylalkyl, hydroxyalkyl, hydroxyaryl, hydroxyalkylaryl, hydroxyarylalkyl groups, or heteroatomic alkyl, aryl, alkylaryl, arylalkyl, hydroxyalkyl, hydroxyaryl, hydroxyalkylaryl, hydroxyarylalkyl groups containing nitrogen, sulfur, or oxygen.

Sufficient concentrations depend on the particular compounds chosen. Hindered phenols, such as BHT, are generally added in the concentration range of about 5 to about 50 mg/l. Peroxide decomposers such as TPP are added in the concentration range of about 20 to about 250 mg/l. Some of the less effective peroxide decomposes, such as hexyl sulfide, must be added at concentrations up to about 10 g/l.

When these two classes of compounds are added to distillate fuels in sufficient quantities (e.g., 25 mg/l BHT and 100 mg/l TPP), oxidation and the formation of peroxides can be nearly eliminated at temperatures up to about 140° C. The oxidation slowing with this additive combination is significantly greater than that observed with standard fuel additives, or with either class individually. In addition, this combination of additives results in substantially reduced hydroperoxide concentrations.

Fuel oxidation and deposition characteristics were evaluated in a quartz crystal microbalance/Parr bomb system (QCM), which has been described in detail previously. See, e.g., Zabamick, *S. Ind. Eng. Chem. Res.* 1994, 33, 1348–1354. Most fuel oxidation tests were run at 140° C. and one atmosphere of air initial pressure. The reactor was heated with a clamp-on band heater, and its temperature was controlled by a PID controller via a thermocouple immersed in the fuel. The device was equipped with a pressure transducer (Sensotec) to measure the absolute headspace pressure and a polarographic oxygen sensor (Ingold) to measure the headspace oxygen concentration. The oxygen sensor and pressure gauge provide information on the oxidation process. As oxygen is consumed in the liquid, oxygen in the headspace diffuses into the liquid resulting in a decrease in the headspace oxygen concentration. The reactor also contained an rf feedthrough, through which the connection for the quartz crystal resonator was attached. The crystals were 2.54 cm in diameter, 0.33 mm thick and had a nominal resonant frequency of 5 MHz. The crystals were acquired from Maxtek Inc. and were available in crystal electrode surfaces of gold, silver, platinum, and aluminum. For the studies reported here gold crystal electrodes were used. The QCM measured deposition (i.e. an increase in mass) which occurred on overlapping sections of the two sided electrodes. Thus, the device responded to deposition which occurred on the metal surface and did not respond to deposition on the exposed quartz.

A personal computer was used to acquire data at one minute intervals during the experimental run. The following data were recorded during a run: temperature, crystal frequency, headspace pressure, headspace oxygen concentration, and crystal damping voltage. The reactor was charged with 60 mL of fuel, which was sparged with air for one hour before each test. The reactor was then sealed, and the heater was started. All runs in this study were performed at 140° C.; heat-up time to this temperature was 40±5 minutes. Most runs were conducted for 15 hours, after which the heater was turned off and the reactor was allowed to cool. Surface mass measurements can only be determined during the constant temperature (±0.2C.) portion of an experimental run. The crystal frequency was converted to a surface mass measurement using a process described previously, see, e.g., Zabarnick, *S. Ind. Eng. Chem. Res.* 1994, 33, 1348–1354.

The ability of hydroperoxide decomposing species to slow and/or delay oxidation of petroleum liquids has been explored in detail previously. In particular, Denison and Condit showed that alkyl sulfides provide substantial oxidation delays in the autoxidation of desulfurized lubricating oils. See, Denison, G. H.; Condit, P. C. *Ind. Eng. Chem.* 1945, 37, 1102–1108. To confirm these results, we tested Exxsol D110, a dearomatized, low sulfur hydrocarbon solvent, with various levels of added hexyl sulfide. The results for the solvent and two concentrations of hexyl sulfide are shown in FIG. 1.

The figure shows that even up to relatively high levels of added hexyl sulfide, no delay or slowing of oxidation was observed, in marked contrast to the results of Denison and Condit.

To explore the cause for this discrepancy, hexyl sulfide was added to a hydrotreated jet fuel, F-2747. The results are shown in FIG. 2.

Figure 2:
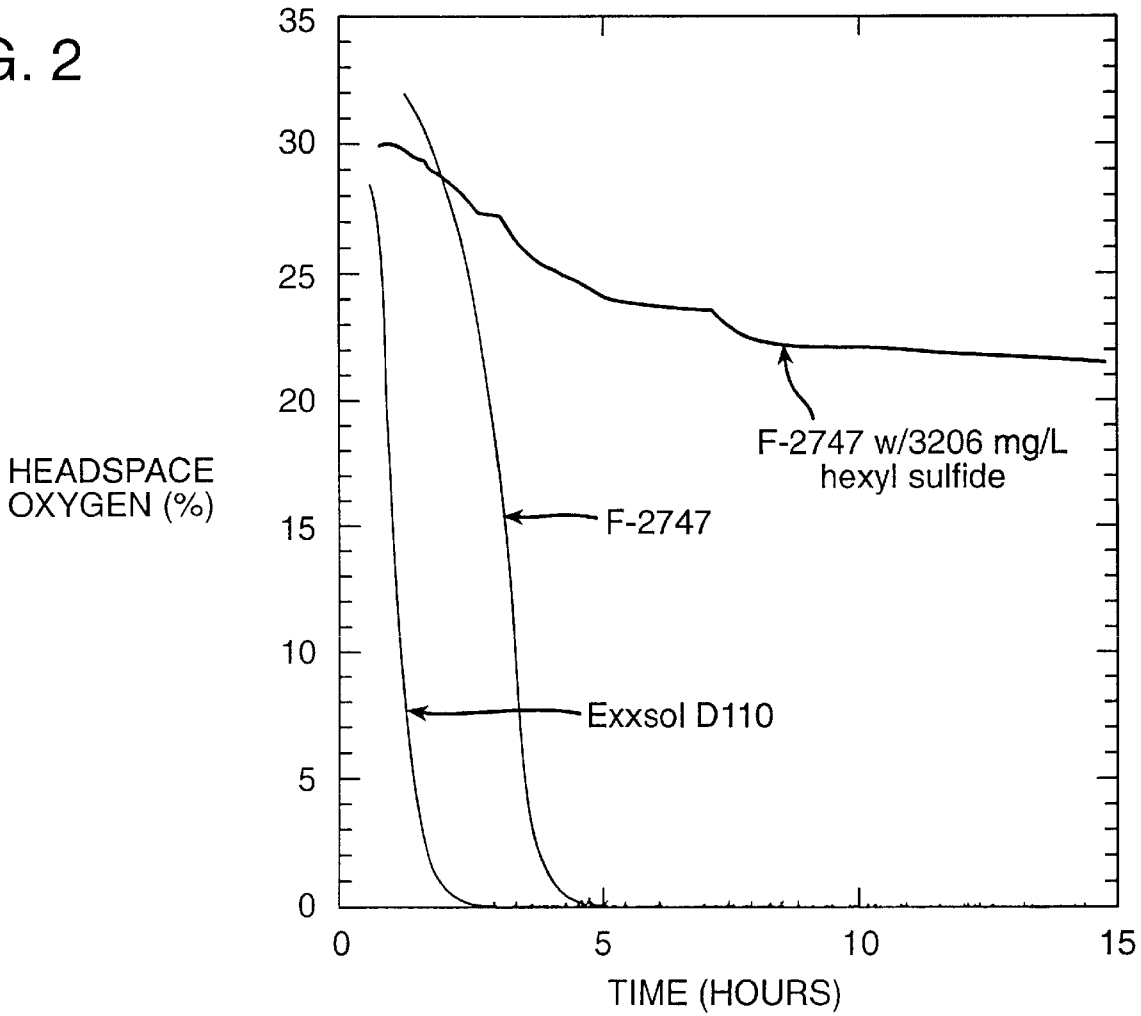
FIG. 2 is a plot of headspace oxygen against time for the oxidation of neat Exxsol D110, fuel F-2747, and fuel F-2747 with added hexyl sulfide.

FIG. 2 shows that, in contrast to Exxsol D110, Jet A-1 fuel displayed substantial delays in oxidation upon the addition of hexyl sulfide. The cause of this difference in behavior can be seen in the oxidation curves for the two neat fuels, shown in FIG. 2.

Under these conditions, fuel F-2747 oxidizes substantially more slowly, consuming oxygen in 4.5 hours, than does Exxsol D110, which consumes oxygen in 2.5 hours. It is apparent that there are naturally occurring and/or added species in the jet fuel which slow the oxidation relative to Exxsol D110.

The JP-8 specification (MEL-T-83133) requires an antioxidant to be added to hydrotreated fuel, and offers the supplier the option of adding antioxidants to non-hydrotreated fuel. The Jet A-1 specification (D1655) does not require antioxidants, but offers the refinery the option of adding one of four antioxidants. Thus, the Jet A-1 fuel may contain up to 24 mg/L of either phenylene diamine or hindered phenol antioxidants. In addition, naturally occurring antioxidants, such as phenols, sulfur, and nitrogen compounds, may be present in the fuel. The slower oxidation of the jet fuel versus Exxsol D110 observed in FIG. 2 is probably due to the presence of antioxidants such as phenols. To test whether the presence of phenols with hexyl sulfide could result in the extremely slow oxidation observed in FIG. 2, we added 2,6-di-tert-butyl-4-methylphenol (BHT) with and without hexyl sulfide to Exxsol D1110. The results are plotted in FIG. 3.

This figure shows that when 30 mg/L of BHT is added to Exxsol D110, there is a resulting ten hour delay before oxidation occurs. The initial slow oxidation during the first ten hours is due to the interception of alkylperoxy radicals by BHT. Previous work has shown that the subsequent rapid oxidation, which occurs here at ten hours, is due to the consumption of BHT below some critical concentration. See, Zabarnick, S.; Whitacre, S. D. *J. Eng. Gas Turbines Power*. 1997, 120, 519–525.

Figure 3:
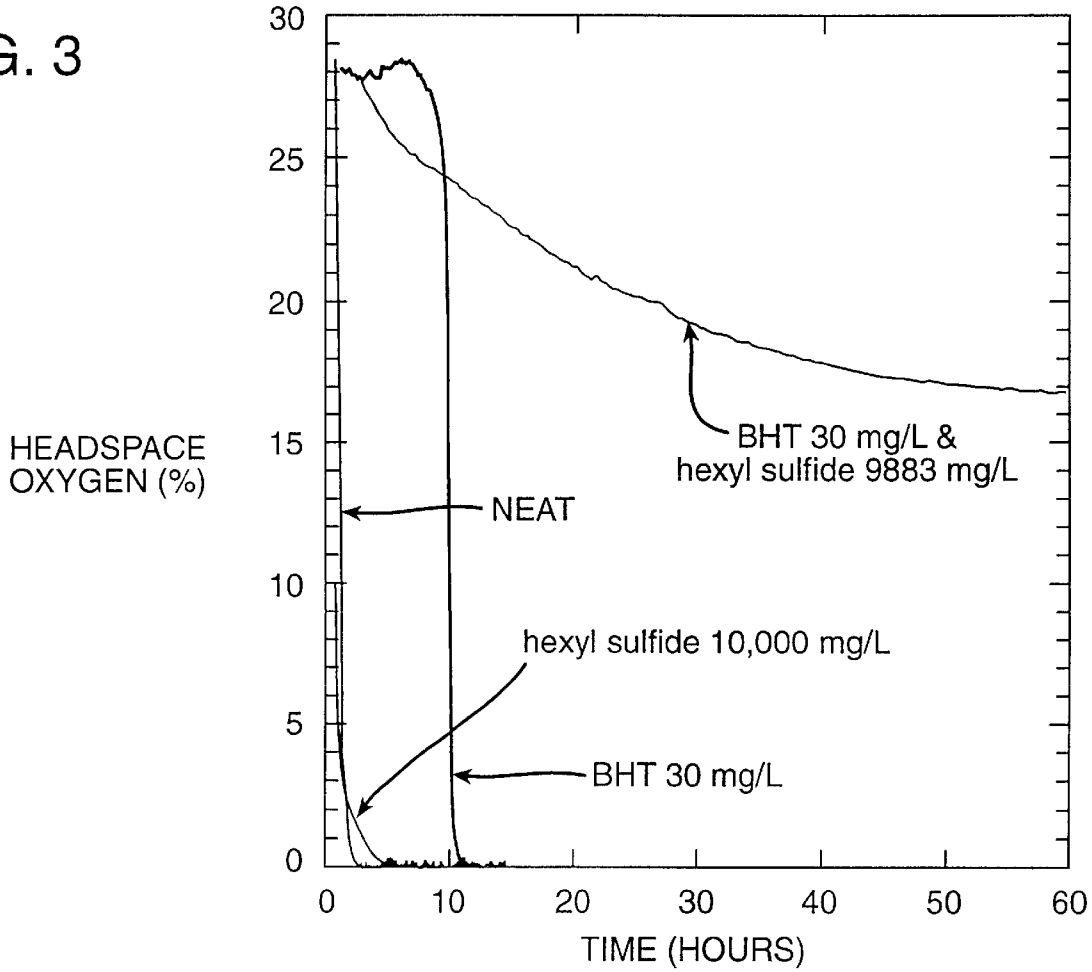
FIG. 3 is a plot of headspace oxygen against time for the oxidation of neat Exxsol D110, with added hexyl sulfide, with added BHT, and with added BHT and hexyl sulfide.

The most striking observation from FIG. 3 is the extremely slow oxidation which occurs when both BHT and hexyl sulfide are present. This run was extended beyond the normal fifteen hour period. The plot show that even after 60 hours over 60% of the oxygen still remains.

The extremely slow oxidation observed when both BHT and hexyl sulfide are present is indicative of a synergistic slowing of oxidation since this oxidation delay is significantly greater than the sum of the individual additives. Synergism between various classes of antioxidants has been observed previously. See, Scott, *G. Chem. and Ind.* 1963, 271–281.

Pseudo-detailed chemical kinetic modeling has predicted the observed behavior between alkylperoxy radical inhibiting antioxidants and hydroperoxide decomposing species. See, Zabarnick, *S. Energ. Fuels*. 1998, 12, 547–553.

The slow oxidation with added alkyl sulfides observed by Condit and Denison in lubricating oils, but not observed here in neat Exxsol D110, is due to the presence of naturally occurring antioxidants in these lubricating oils, presumably alkylperoxy radical inhibitors such as phenols. It is apparent that alkyl sulfides alone do not slow/delay oxidation, but in the presence of inhibiting phenols a substantial synergistic slowing of oxidation is observed.

Figure 4:
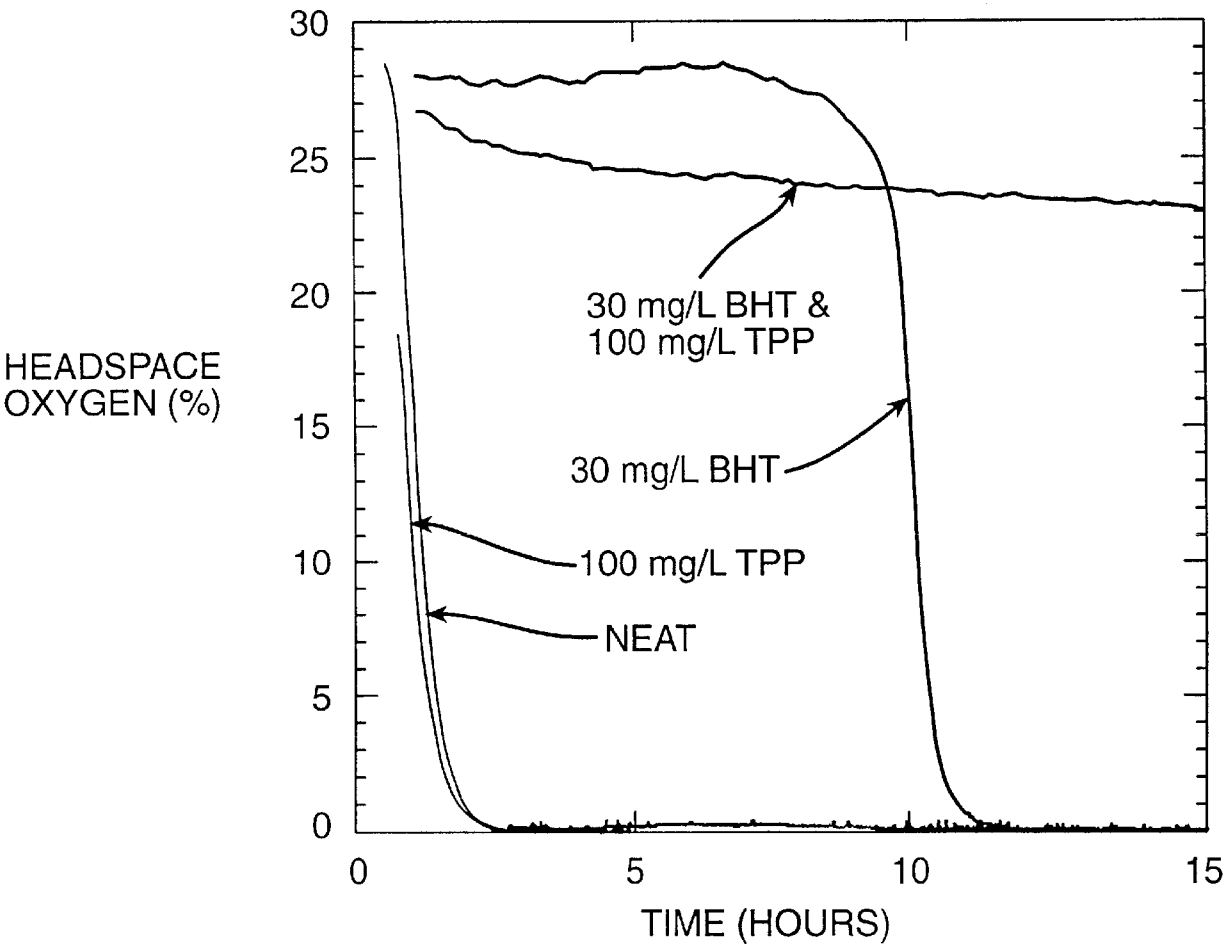
FIG. 4 is a plot of headspace oxygen against time for the oxidation of neat Exxsol D110, with added triphenylphosphine (TPP), with added BHT, and with added BHT and triphenylphosphine.

FIG. 4 shows results using triphenylphosphine as the peroxide decomposing species. The figure shows that 100 mg/l of triphenylphosphine alone has little effect on the oxidation rate of Exxsol D110. Adding BHT results in a delay in oxidation for ten hours, but when the BHT is consumed rapid oxidation commences. The figure shows that in the presence of BHT at 30 mg/L and triphenylphosphine at 100 mg/L the oxidation process is nearly shutdown for the entire 15 hours test. The figure demonstrates that a synergistic slowing of oxidation occurs in the presence of these two additives.

Having described the invention in detail and by reference to preferred embodiments thereof, it will be apparent that modifications and variations are possible without departing from the scope of the invention defined in the appended claims.

What is claimed is:

1. A composition comprising:

a liquid hydrocarbon selected from distillate fuels, kerosene and solvents; and a liquid hydrocarbon stabilizer comprising:

a hindered phenol in an amount in the range of from about 5 to about 50 mg/l, the hindered phenol having a general formula

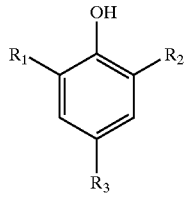

where $R_1$, $R_2$, and $R_3$ are the same or different and are each alkyl, aryl, alkylaryl, arylalkyl, hydroxyalkyl, hydroxyaryl, hydroxyalkylaryl, hydroxyarylalkyl groups, or heteroatomic alkyl, aryl, alkylaryl, arylalkyl, hydroxyalkyl, hydroxyaryl, hydroxyalkylaryl, hydroxyarylalkyl groups containing nitrogen, sulfur, or oxygen and where at least one of $R_1$ and $R_2$ provide stearic hindrance; and a peroxide decomposer in an amount of from about 20 to about 250 mg/l, the peroxide decomposer having a general formula $PR_6R_7R_8$ where $R_6$, $R_7$, and $R_8$ are the same or different and are each alkyl, aryl, alkylaryl arylalkyl, hydroxyalkyl, hydroxyaryl, hydroxyalkylaryl, hydroxyarylalkyl groups, or heteroatomic alkyl, aryl, alkylaryl, arylalkyl, hydroxyalkyl, hydroxyaryl, hydroxyalkylaryl, hydroxyarylalkyl groups containing nitrogen, sulfur, or oxygen.

2. The composition of claim 1 wherein the peroxide decomposer is triphenylphosphine.

3. The composition of claim 1 wherein $R_1$ is selected from isobutyl or tertiary butyl groups.

4. The composition of claim 3 wherein $R_2$ is selected from isobutyl or tertiary butyl groups.

5. The composition of claim 1 wherein the hindered phenol is selected from 2,6-di-tert-butyl-4-methylphenol or 6-tert-butyl-2,4-dimethylphenol.

6. The composition of claim 1 wherein the liquid hydrocarbon is selected from gasoline, diesel fuel, or jet fuel.

7. A method of treating liquid hydrocarbons comprising introducing a liquid hydrocarbon stabilizer into a liquid hydrocarbon selected from distillate fuels, kerosene and solvents, the liquid hydrocarbon stabilizer comprising:

a hindered phenol in an amount in the range of from about 5 to about 50 mg/l, the hindered phenol having a general formula

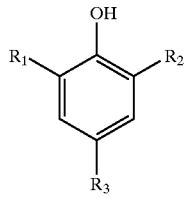

where $R_1$, $R_2$, and $R_3$ are the same or different and are each alkyl, aryl, alkylaryl, arylalkyl, hydroxyalkyl, hydroxyaryl, hydroxyalkylaryl, hydroxyarylalkyl groups, or heteroatomic alkyl, aryl, alkylaryl, arylalkyl, hydroxyalkyl, hydroxyaryl, hydroxyalkylaryl, hydroxyarylalkyl groups containing nitrogen, sulfur, or oxygen and where at least one of $R_1$ and $R_2$ provide stearic hindrance; and a peroxide decomposer in an amount of from about 20 to about 250 mg/l, the peroxide decomposer having a general formula $PR_6R_7R_8$ where $R_6$, $R_7$, and $R_8$ are the same or different and are each alkyl, aryl, alkylaryl, arylalkyl, hydroxyalkyl, hydroxyaryl, hydroxyalkylaryl, hydroxyarylalkyl groups, or heteroatomic alkyl, aryl, alkylaryl, arylalkyl, hydroxyalkyl, hydroxyaryl, hydroxyalkylaryl, hydroxyarylalkyl groups containing nitrogen, sulfur, or oxygen.

8. The method of claim 7 wherein the peroxide decomposer is triphenylphosphine.

9. The method of claim 7 wherein $R_1$ is selected from isobutyl or tertiary butyl groups.

10. The method of claim 9 wherein $R_2$ is selected from isobutyl or tertiary butyl groups.

11. The method of claim 7 wherein the hindered phenol is selected from 2,6-di-tert-butyl-4-methylphenol or 6-tert-butyl-2,4-dimethylphenol.

12. The method of claim 7 wherein the liquid hydrocarbon is selected from gasoline, diesel fuel, or jet fuel.

13. A composition comprising:

a liquid hydrocarbon selected from distillate fuels, kerosene and solvents; and a liquid hydrocarbon stabilizer comprising:

a hindered phenol in an amount in the range of from about 5 to about 50 mg/l, the hindered phenol having a general formula

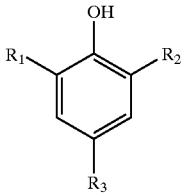

where $R_1$, $R_2$, and $R_3$ are the same or different and are each alkyl, aryl, alkylaryl, arylalkyl, hydroxyalkyl, hydroxyaryl, hydroxyalkylaryl, hydroxyarylalkyl groups, or heteroatomic alkyl, aryl, alkylaryl, arylalkyl, hydroxyalkyl, hydroxyaryl, hydroxyalkylaryl, hydroxyarylalkyl groups containing nitrogen, sulfur, or oxygen and where at least one of $R_1$ and $R_2$ provide stearic hindrance; and a peroxide decomposer in an amount less than about 10 g/l, the peroxide decomposer having a general formula $R_4$—S—$R_5$, where $R_4$ and $R_5$ are the same or different and are each alkyl, aryl, alkylaryl, arylalkyl, hydroxyalkyl, hydroxyaryl, hydroxyalkylaryl, hydroxyarylalkyl groups, or heteroatomic alkyl, aryl, alkylaryl, arylalkyl, hydroxyalkyl, hydroxyaryl, hydroxyalkylaryl, hydroxyarylalkyl groups containing nitrogen, sulfur, or oxygen.

14. The composition of claim 13 wherein the peroxide decomposer is hexyl sulfide.

15. The composition of claim 13 wherein $R_1$ is selected from isobutyl or tertiary butyl groups.

16. The composition of claim 15 wherein $R_2$ is selected from isobutyl or tertiary butyl groups.

17. The composition of claim 13 wherein the hindered phenol is selected from 2,6-di-tert-butyl-4-methylphenol or 6-tert-butyl-2,4-dimethylphenol.

18. The composition of claim 13 wherein the liquid hydrocarbon is selected from gasoline, diesel fuel, or jet fuel.

19. A method of treating liquid hydrocarbons comprising introducing a liquid hydrocarbon stabilizer into a liquid hydrocarbon selected from distillate fuels, kerosene and solvents, the liquid hydrocarbon stabilizer comprising:

a hindered phenol in an amount in the range of from about 5 to about 50 mg/l, the hindered phenol having a general formula

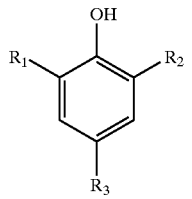

where $R_1$, $R_2$, and $R_3$ are the same or different and are each alkyl, aryl, alkylaryl, arylalkyl, hydroxyalkyl, hydroxyaryl, hydroxyalkylaryl, hydroxyarylalkyl groups, or heteroatomic alkyl, aryl, alkylaryl, arylalkyl, hydroxyalkyl, hydroxyaryl, hydroxyalkylaryl, hydroxyarylalkyl groups containing nitrogen, sulfur, or oxygen and where at least one of $R_1$ and $R_2$ provide stearic hindrance; and a peroxide decomposer in an amount less than about 10 g/l, the peroxide decomposer having a general formula $R_4$—S—$R_5$ where $R_4$ and $R_5$ are the same or different and are each alkyl, aryl, alkylaryl, arylalkyl, hydroxyalkyl, hydroxyaryl, hydroxyalkylaryl, hydroxyarylalkyl groups, or heteroatomic alkyl, aryl, alkylaryl, arylalkyl, hydroxyalkyl, hydroxyaryl, hydroxyalkylaryl, hydroxyarylalkyl groups containing nitrogen, sulfur, or oxygen.

20. The method of claim 19 wherein the peroxide decomposer is hexyl sulfide.

21. The method of claim 19 wherein $R_1$ is selected from isobutyl, or tertiary butyl groups.

22. The method of claim 21 wherein $R_2$ is selected from isobutyl, or tertiary butyl groups.

23. The method of claim 19 wherein the hindered phenol is selected from 2,6-di-tert-butyl-4-methylphenol or 6-tert-butyl-2,4-dimethylphenol.

24. The method of claim 19 wherein the liquid hydrocarbon is selected from gasoline, diesel fuel, or jet fuel.

* * * * *

UNITED STATES PATENT AND TRADEMARK OFFICE

CERTIFICATE OF CORRECTION

PATENT NO. : 6,475,252 B1
DATED : November 5, 2002
INVENTOR(S) : Shawn P. Heneghan et al.

It is certified that error appears in the above-identified patent and that said Letters Patent is hereby corrected as shown below:

Column 2,
Line 15, "n" should be -- a --;
Line 52, "The to hindered phenol" should be -- The hindered phenol --; and Column 5,
Line 51, "(MEL-T-83133)" should be -- (MIL-T-83133) --.

Signed and Sealed this

Eighteenth Day of February, 2003

JAMES E. ROGAN
*Director of the United States Patent and Trademark Office*